US007957672B2

(12) United States Patent
Kato et al.

(10) Patent No.: US 7,957,672 B2
(45) Date of Patent: Jun. 7, 2011

(54) IMAGE FORMING APPARATUS WITH A BELT UNIT

(75) Inventors: Atsushi Kato, Ichinomiya (JP); Hirotaka Mori, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1199 days.

(21) Appl. No.: 11/488,133

(22) Filed: Jul. 18, 2006

(65) Prior Publication Data

US 2007/0025762 A1 Feb. 1, 2007

(30) Foreign Application Priority Data

Jul. 26, 2005 (JP) ..... 2005-216178

(51) Int. Cl.
*G03G 15/08* (2006.01)

(52) U.S. Cl. ..... 399/121

(58) Field of Classification Search ..... 399/121
See application file for complete search history.

(56) References Cited

U.S. PATENT DOCUMENTS

| | | | | |
|---|---|---|---|---|
| 4,563,077 | A * | 1/1986 | Komada | 399/165 |
| 5,991,575 | A | 11/1999 | Okiyama et al. | |
| RE37,157 | E * | 5/2001 | Ikeda et al. | 399/124 |
| 6,445,895 | B2 * | 9/2002 | Shirasawa et al. | 399/116 |
| 6,556,802 | B2 * | 4/2003 | Sasamoto et al. | 399/299 |
| 6,560,428 | B2 * | 5/2003 | Sanchez-Banos et al. | 399/165 |
| 2001/0022903 | A1 | 9/2001 | Shirasawa et al. | |
| 2007/0177894 | A1 * | 8/2007 | Nakano et al. | 399/121 |

FOREIGN PATENT DOCUMENTS

| | | | |
|---|---|---|---|
| DE | 3236854 | A1 | 4/1983 |
| JP | 05-018450 | A | 1/1993 |
| JP | 05-216304 | A | 8/1993 |
| JP | 8241014 | | 9/1996 |
| JP | 11272124 | | 10/1999 |
| JP | 2000-231275 | | 8/2000 |
| JP | 2000-284607 | | 10/2000 |
| JP | 2000-284608 | | 10/2000 |
| JP | 2001-209294 | | 8/2001 |
| JP | 2001-209294 | A | 8/2001 |
| JP | 2002-091185 | A | 3/2002 |
| JP | 2003-208039 | | 7/2003 |
| JP | 2006-017921 | A | 1/2006 |

OTHER PUBLICATIONS

Extended European Search Report dated Apr. 12, 2006 in Application No. EP06014953.1.
European Search Report dated Jan. 26, 2007 in Application No. EP06014953.1.
Office Actionn issued May 20, 2010 in corresponding Japanese Patent Application No. 2005-216178, and English translation thereof.

* cited by examiner

*Primary Examiner* — David M Gray
*Assistant Examiner* — Andrew V Do
(74) *Attorney, Agent, or Firm* — Banner & Witcoff, Ltd.

(57) ABSTRACT

An image formation apparatus is provided that prevents a belt from becoming displaced or detached from a belt unit. When a belt unit is detached from a main body casing, a tension roller is fixed in an outwardly protruding position by a fixing member. Thereby, the conveyor belt is stretched such that the conveyor belt is configured to be prevented from becoming displaced or detached. When the belt unit is mounted in the main body casing, fixation of the tension roller by the fixing member is released by a releasing protrusion and a suitable operating tensile force is imparted to the conveyor belt by coiled springs provided on the main body casing side.

15 Claims, 13 Drawing Sheets

IMAGE FORMING APPARATUS WITH A BELT UNIT

CROSS REFERENCE TO RELATED APPLICATIONS

This application claims priority from Japanese Patent Application No. 2005-216178 filed Jul. 26, 2005. The entire content of this priority application is incorporated herein by reference.

TECHNICAL FIELD

The disclosure relates to an image forming apparatus such as a laser printer, and more particularly to an image forming apparatus equipped with a detachable belt unit.

BACKGROUND

Conventionally, an image forming apparatus is known such as a laser printer that uses a belt for conveying sheets, performing intermediate transferring, and the like. In general, this type of belt (in the form of a belt unit) can be detached from the main body of the apparatus in order to enable the replacement or repair of the belt, typically after a predetermined period of use.

Normally, the belt unit is provided with a tension imparting component comprising a coiled spring or the like. The tension imparting component imparts a tensile force to the belt by urging a tension roller in an outward direction. The tension roller supports the belt and can change position in an inward or outward direction.

In contrast thereto, Japanese Laid-Open Patent No. 2001-209294 discloses an apparatus in which a tension imparting component is provided on the main body side of the apparatus. This tension imparting component is configured so that a predetermined tensile force is imparted to the belt. This is as a result of the tension imparting component urging the tension roller outward when the belt unit is mounted in the apparatus main body. In this apparatus, the structure of the belt unit is simplified because the tension imparting component is not provided in the belt unit.

In the configuration such as that of the previously described Japanese Laid-Open Patent No. 2001-209294, the belt has conventionally been formed of a hard material such as polyamide-imide. Therefore, changes in the peripheral length of the belt were relatively small. As a result, it was sufficient for the tension roller to have a relatively small moveable range. The belt did not slacken significantly even when the belt unit was detached from the apparatus main body.

Recently however due to demands for greater durability, there is an increasing use of belts that are made of a material that is more flexible than the conventional belt. Although this type of belt provides greater durability than a conventional belt material, such as polyamide-imide, belt elongation and changes in the peripheral length of the belt due to thermal expansion have increased.

When the use of a belt made of this kind of flexible material was attempted in the apparatus disclosed in the previously described Japanese Laid-Open Patent No. 2001-209294, it was necessary to increase the moveable range of the tension roller in order to correspond to the changes in the peripheral length of the belt. As a result, there was a problem such that the slackening of the belt increased when the belt unit was detached from the apparatus main body. Therefore, the belt was liable to be displaced along a width direction (axial direction of the rollers) and become detached from the belt unit.

SUMMARY

At least some aspects of the present invention relate to preventing a belt from becoming displaced or detached from a belt unit. In order to achieve the above object, an image forming apparatus according to an aspect of the invention is provided comprising a belt unit having a belt, a plurality of rollers supporting the belt in a stretched state, and a frame rotatably supporting the rollers. In addition there is an apparatus main body in which the belt unit is detachably mounted, and which has a tension imparting device that imparts an operating tensile force to the belt when mounting the belt unit.

The belt unit is provided with a securing member disposed on an inner surface side of the belt that is configured to change position in a tension inducing direction (e.g., an inner or outer direction) with respect to the belt. The securing member stretches the belt by projecting outwardly in a state in which the belt unit is detached from the apparatus main body. Since the belt is stretched by the securing member projecting outward when the belt unit is detached from the apparatus main body, it is possible to inhibit the belt from becoming displaced or detached.

According to another aspect of the invention, an image forming apparatus is provided according to a previous aspect in which guide ribs are provided in a protruding condition on an inner surface of the belt. The guide ribs engage with the rollers to inhibit skewing of the belt.

In a case where guide ribs for skew prevention are provided on the inner surface of a belt, for example, in a replacement belt unit or the like, there is a risk of the guide ribs overriding the rollers and dropping off when the belt slackens and is axially (horizontally) displaced in a state in which tension is not imparted to the belt.

If the belt unit is mounted in a state in which the guide ribs are not properly located, and an operating tensile force is imparted to the belt by a tension imparting device, a difference in the level of the outer surface of the belt is produced at the boundary between the region in which the belt directly contacts the roller surface and the region in which the belt contacts the roller surface via the rib. This creates the possibility that a stress concentration may be produced in this portion of the belt and subsequently damage the belt.

In contrast, according to the present structure, since the belt is stretched by the outward projection of the securing member when the belt unit is detached from the apparatus main body, the state is maintained in which the guide ribs are engaged with the rollers. Consequently, the previously described stress concentration and possible damage to the belt is prevented.

In an aspect of the current invention, an image forming apparatus includes a belt unit detachably mounted to an apparatus main body. The belt unit comprises a belt, a plurality of rollers supporting the belt in a stretched state, and a frame rotatably supporting the rollers. The image forming apparatus also includes a tension imparting device that imparts an operating tensile force to the belt of the belt unit in a mounted state.

The belt unit also comprises a plurality of securing members located along an inner surface side of the belt. The plurality of securing members imparts a tensile force to the belt when the belt unit is detached from the apparatus main body. The plurality of securing members imparts the tensile force via a change position in an inner or outer direction with respect to a circumference of the belt.

BRIEF DESCRIPTION OF THE DRAWINGS

Illustrative aspects in accordance with the invention will be described in detail with reference to the following figures wherein.

DETAILED DESCRIPTION

An aspect of the image forming apparatus will now be described with reference to FIGS. 1 to 6.

(Overall Structure of the Image Forming Apparatus)

Figure 1:
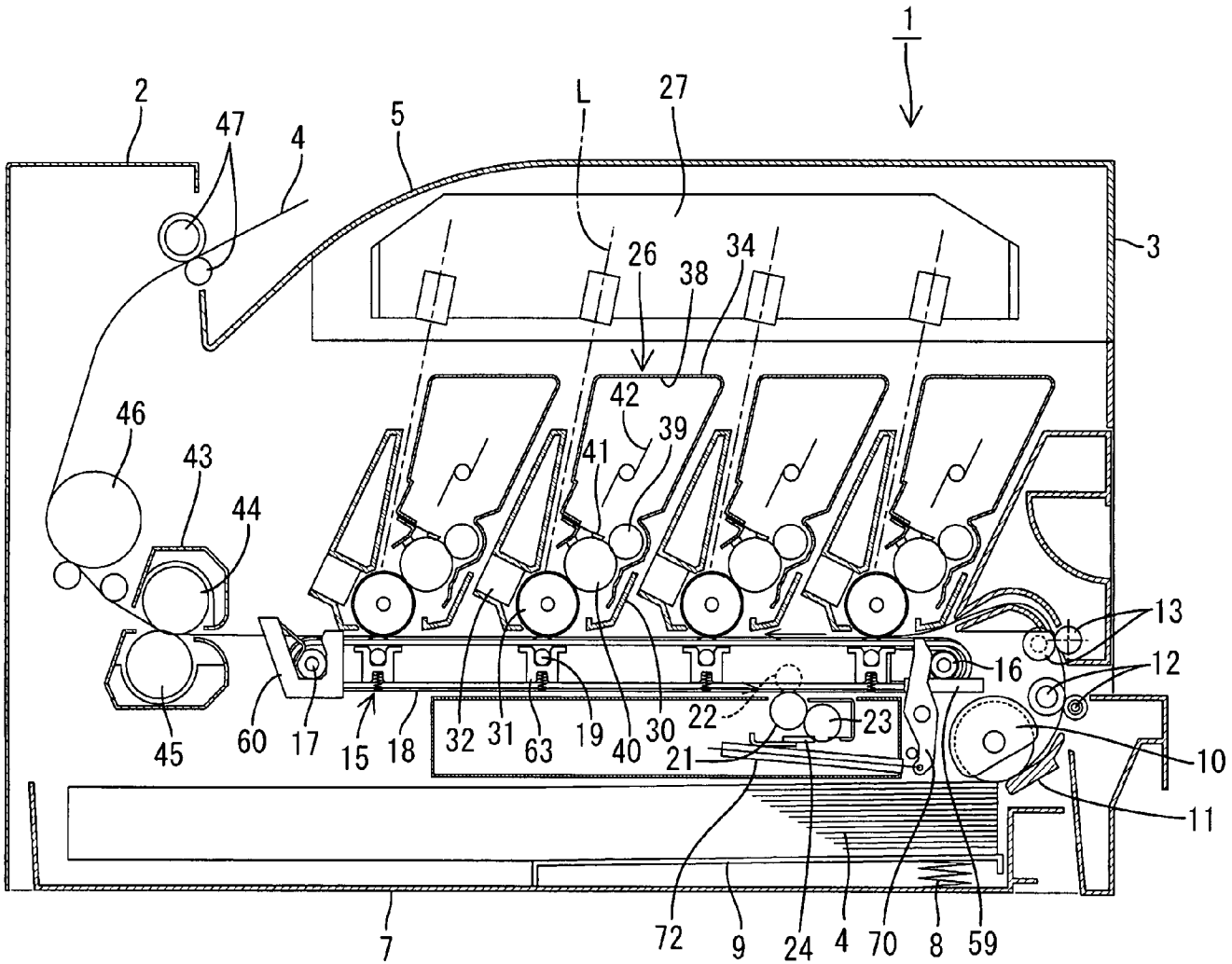
FIG. 1 is a side sectional view showing a schematic configuration of a laser printer according to an aspect of the present invention.
Figure 2:
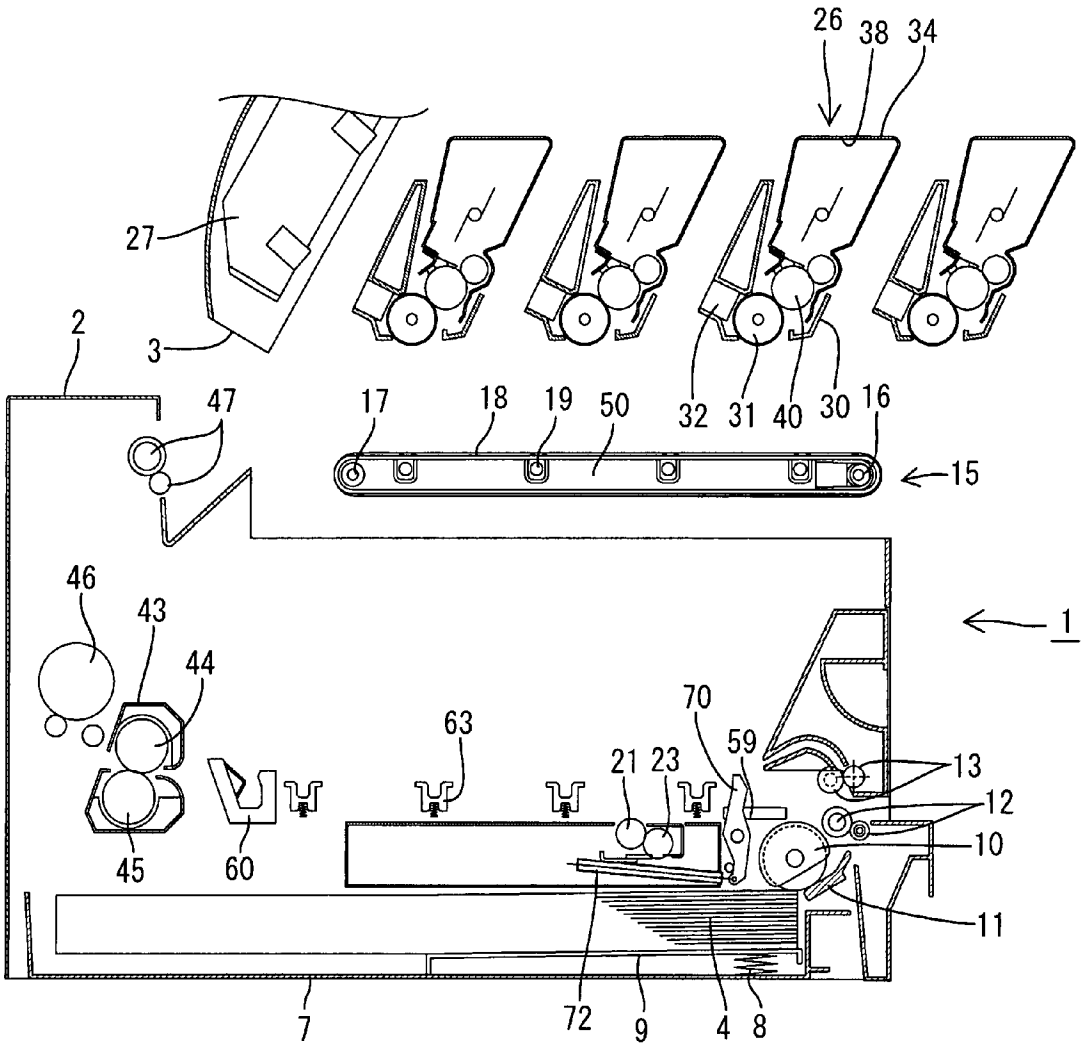
FIG. 2 is a side sectional view of the laser printer in a state in which the belt unit was detached therefrom.

FIG. 1 is a side sectional view showing the schematic configuration of a laser printer 1 as an illustrative aspect of the image forming apparatus. FIG. 2 is a side sectional view of the laser printer 1 showing the state in which process cartridges 26 and a belt unit 15 are detached therefrom. In the following description, the right side in FIG. 1 is taken as the front side.

The laser printer 1 is a direct transfer type tandem color laser printer comprising, as shown in FIG. 1, a substantially rectangular main body casing 2 (corresponding to an example of the apparatus main body). A top cover 3 is provided on the top surface of the main body casing 2. The top cover 3 is capable of opening and closing. It is possible to exchange the process cartridges 26 and/or the belt unit 15 located inside the main body casing 2 by opening this top cover 3, as shown in FIG. 2. On the upper surface of the top cover 3 is formed a discharge tray 5 on which sheets 4 are stacked after image formation.

A sheet supply tray 7 is mounted in the lower part of the main body casing 2 in a condition in which it can be drawn out towards the front of the laser printer 1. The sheets 4 for forming images are loaded in the sheet supply tray 7. A sheet pressing plate 9 and a spring 8 are arranged within the sheet supply tray 7. The sheet pressing plate 9 can tilt so as to lift the front end side of the sheets 4 through the urging of the spring 8.

A pickup roller 10 and a separation pad 11 are provided at an upper position at the front end of the sheet supply tray 7. The separation pad 11 is pressed against the pickup roller 10 through the urging of an unshown spring. Further, a pair of sheet feeding rollers 12 is provided at a slanting position that is forward and upward of the pickup roller 10. A pair of registration rollers 13 is further provided upward of the pair of sheet feeding rollers 12.

The uppermost sheets 4 in the sheet supply tray 7 are pressed toward the pickup roller 10 by the sheet pressing plate 9. When the sheets 4 are sandwiched between the pickup roller 10 and the separation pad 11, the uppermost sheets 4 are separated into single sheets by the rotation of the pickup roller 10. A sheet 4, which is delivered from between the pickup roller 10 and the separation pad 11, is fed towards the registration rollers 13 by the sheet feeding rollers 12. At the registration rollers 13, the sheet 4 is delivered at a predetermined timing onto the belt unit 15.

The belt unit 15 is positioned to the rear of the registration rollers 13 and is detachable from the main body casing 2. The belt unit 15 comprises a conveyor belt 18, which is horizontally suspended between a pair of rollers 16 and 17. Each of the rollers 16 and 17 is respectively disposed in a separated condition at the front and rear of the belt unit 15. Of the pair of rollers 16 and 17, the rear-side roller is a driving roller 17, which is rotationally driven by the power of an unshown motor. The front-side roller is a tension roller 16 (corresponding to an example of a securing member) used to impart a tensile force upon the conveyor belt 18, as described later.

The conveyor belt 18 is a belt composed of a resin material such as polycarbonate. The conveyor belt 18 moves in a circulating manner in a counter-clockwise direction, as viewed in FIG. 1, due to the rotational driving of the driving roller 17. The movement of the conveyor belt 18 conveys a sheet 4 that was delivered onto the upper surface thereof.

Four transfer rollers 19 are disposed on an inner surface side of the conveyor belt 18 opposing the photosensitive drums 31 (corresponding to examples of image bearing devices) of the process cartridges 26, as described later. The four transfer rollers 19 are provided along a line at fixed intervals in a front to rear direction. The conveyor belt 18 is sandwiched between each transfer roller 19 and a corresponding photosensitive drum 31. At the time of an image transfer, a transfer bias is applied between the relevant transfer roller 19 and the corresponding photosensitive drum 31. The structure of the belt unit 15 is described in detail later.

A cleaning roller 21 is provided on the underside of the belt unit 15 for removing paper powder and toner or the like, which may be attached to the conveyor belt 18. The cleaning roller 21 comprises a structure in which a foamed material comprising silicon is provided around a shaft material made of metal. The cleaning roller 21 is disposed opposite to a metal backup roller 22 arranged within the belt unit 15, thereby sandwiching the conveyor belt 18. Upon the application of a predetermined bias between the cleaning roller 21 and the backup roller 22, any toner and the like located on the conveyor belt 18 is electrically attracted to the side of the cleaning roller 21.

A metal collection roller 23 is arranged so as to contact the cleaning roller 21 and remove any toner and the like that may be adhered to the surface thereof. Further, a blade 24 is arranged so as to contact the collection roller 23 in order to scrape off the toner and the like adhered to the surface thereof.

Four process cartridges 26, which correspond to the colors magenta, yellow, cyan, and black, are respectively provided side-by-side in the front to rear direction in a detachable condition above the belt unit 15. A scanner portion 27 is provided and is integrally attached to the top cover 3, on top of the process cartridges 26. The scanner portion 27 irradiates a laser beam L for each color onto the surface of the corresponding photosensitive drum 31 by high speed scanning thereof, based on predetermined image data.

The process cartridge 26 comprises a frame-shaped cartridge frame 30, a scorotron charging device 32 and a photosensitive drum 31 arranged at the bottom of the cartridge frame 30, and a development cartridge 34 that is detachably mounted onto the cartridge frame 30.

The photosensitive drum 31 comprises a grounded metal drum main body. The photosensitive drum 31 is formed by coating the surface thereof with a positively charged photosensitive layer made of polycarbonate or the like.

The scorotron charging device 32 is disposed facing the photosensitive drum 31 in a position diagonally above the rear side of the photosensitive drum 31. The scorotron charging device 32 is spaced apart from the photosensitive drum 31 by a specified interval so as to not come in contact therewith. The scorotron type charging unit 32 is provided in order to uniformly and positively charge the surface of the photosensitive drum 31 by generating a corona discharge from a charging wire made of material such as tungsten.

The development cartridge 34 is formed in a substantially box shape. Inside of the development cartridge 34, a toner containing chamber 38 is provided in the upper part thereof. A supply roller 39, a developing roller 40, and a layer thickness regulating blade 41, are provided in the lower part thereof. The toner containing chambers 38 of each of the development cartridges 34 are respectively filled with a positive charging nonmagnetic one-component toner of each of the colors yellow, magenta, cyan, and black, as a developing agent. An agitator 42 is provided in each toner containing chamber 38 for agitating the toner.

The supply roller 39 is formed by coating a metal roller shaft with a conductive foam material. The developing roller 40 is formed by coating a metal roller shaft with a conductive rubber material. The toner, discharged from a toner containing chamber 38, is supplied to the corresponding developing roller 40 via the rotation of the supply roller 39. The toner is positively charged at this time by friction between the supply roller 39 and the developing roller 40. Further, the toner supplied onto the developing roller 40 enters a space between the layer thickness regulating blade 41 and the developing roller 40 occurring with the rotation of the developing roller 40. The toner is thoroughly further charged at this time due to friction and is supported as a thin layer having a specified thickness on the surface of the developing roller 40.

At the time of rotation, the surface of the photosensitive drum 31 is initially charged uniformly and positively by the scorotron charging device 32. Thereafter, the surface of the photosensitive drum 31 is exposed by high-speed scanning of a laser beam from the scanner portion 27, whereby an electrostatic latent image is formed thereon that corresponds to an image to be formed on the sheet 4.

Subsequently, when the positively charged toner, which is carried on the developing roller 40, faces (opposes) and comes in contact with the photosensitive drum 31 through the rotation of the developing roller 40, the toner is supplied to the electrostatic latent image formed on the surface of the photosensitive drum 31. Thereby, the electrostatic latent image on the photosensitive drum 31 is visualized, and a toner image formed by reversal development is carried on the surface of the photosensitive drum 31.

Thereafter, the toner images carried on the surfaces of each photosensitive drum 31 are transferred in sequence to a sheet 4 due to a negative transfer bias. The negative transfer bias is applied to the transfer rollers 19 while the sheet 4, which is conveyed by the conveyor belt 18, passes through each transferring position between the corresponding transfer rollers 19 and photosensitive drums 31. The sheet 4, onto which the toner images were transferred to in this manner, is subsequently conveyed to a fixing device 43.

The fixing device 43 is disposed downstream (with respect to the conveyance direction) of the conveyor belt 18, inside of the main body casing 2. The fixing device 43 comprises a heat roller 44 that is rotationally driven. The heat roller 44 includes a heat source such as a halogen lamp. A pressure roller 45 is disposed below the heat roller 44 in such a way as to face and press against the heat roller 44. The pressure roller 45 is rotated in accordance with the rotational driving of the heat roller 44.

In the fixing device 43, the toner images are fixed to the sheet 4 carrying the four colors of toner images by heating the sheet 4 while the sheet 4 is being compressed and conveyed by the heat roller 44 and the pressure roller 45. Thereafter, the sheet 4 (onto which the toner images were fixed by heating) is conveyed to discharge rollers 47 that are provided in the upper part of the main body casing 2. The sheet 4 is conveyed by a conveyance roller 46 disposed in a slanting manner downstream (with respect to the conveyance direction) and upward of the fixing device 43. The sheet 4 is discharged onto the aforementioned discharge tray 5 by the discharge rollers 47.

(Structure of a Belt Unit)

Figure 3A:
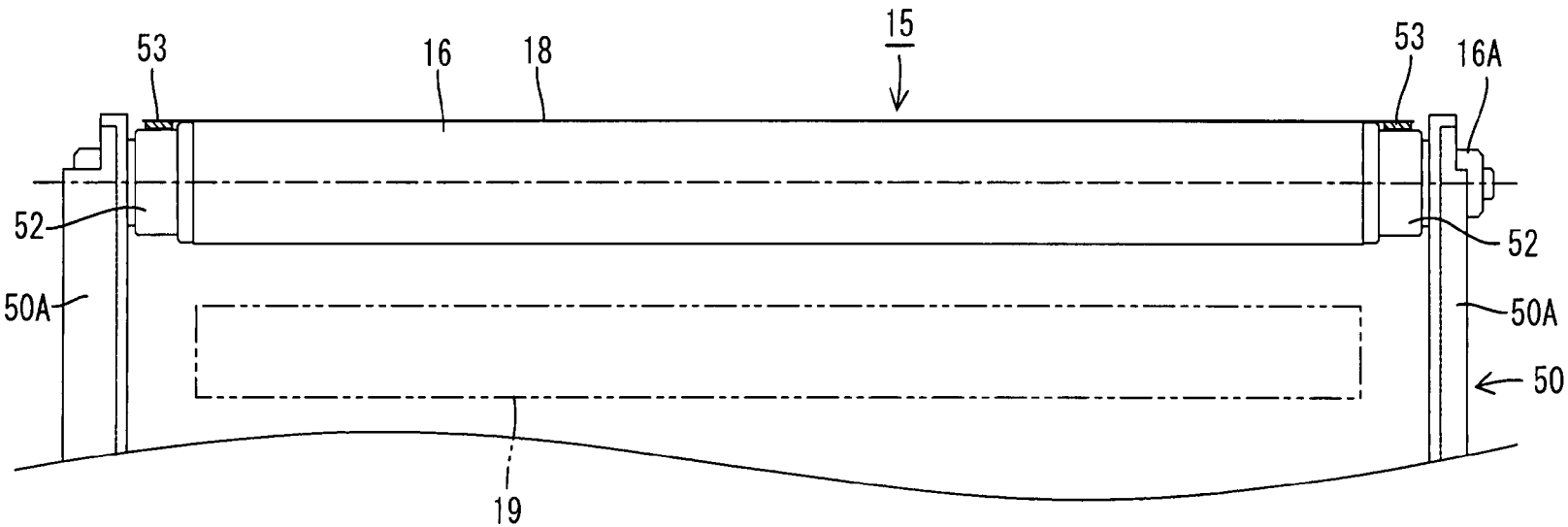
FIG. 3A is a partial enlarged plan view of the belt unit that shows a state in which the conveyor belt is stretched normally.
Figure 3B:
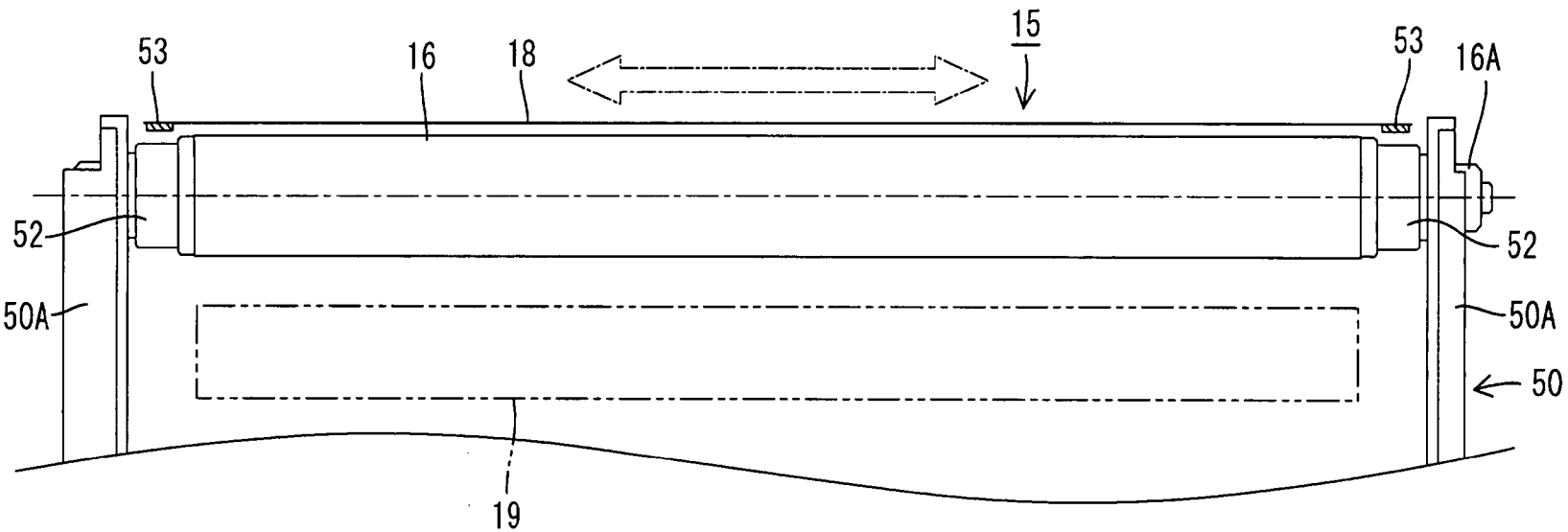
FIG. 3B is a partial enlarged plan view of the belt unit that shows a state in which the conveyor belt has separated from the roller.
Figure 4:
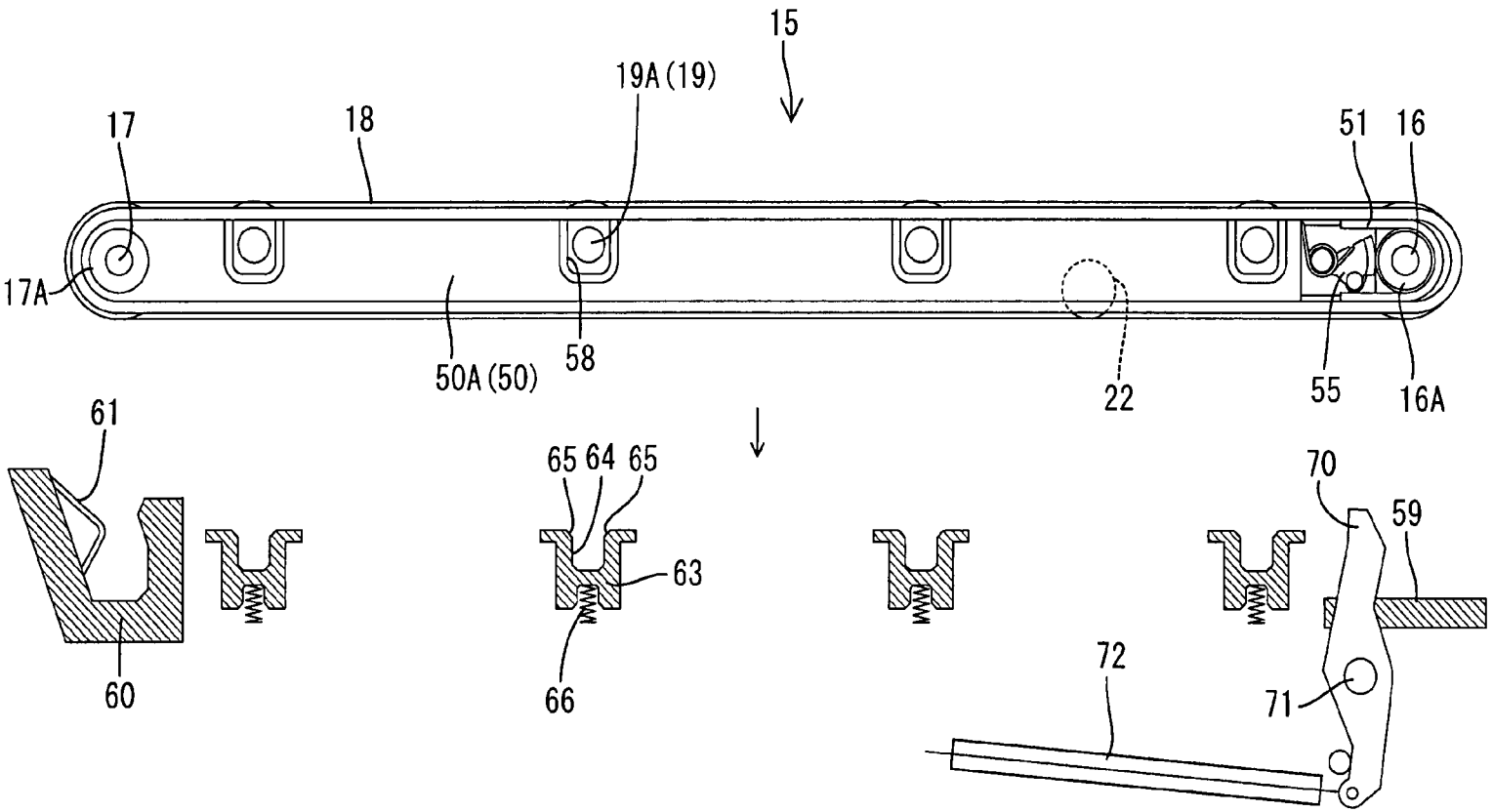
FIG. 4 is a side sectional plan view showing the state of the belt unit prior to mounting.
Figure 5:
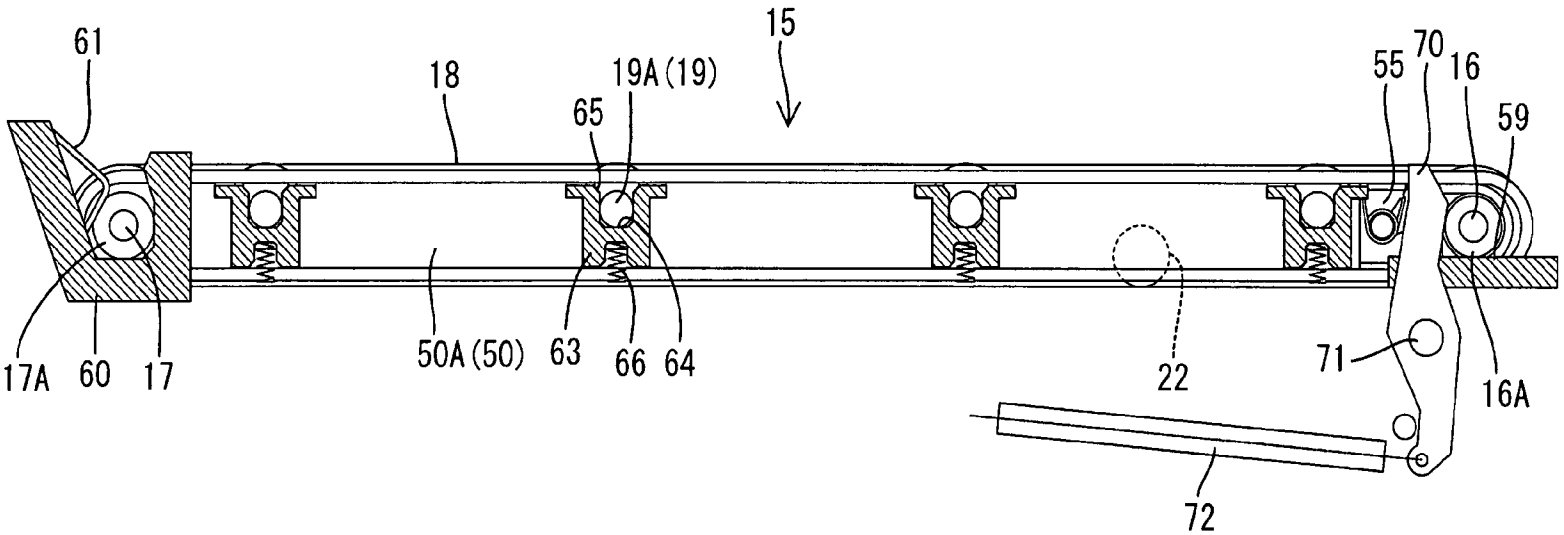
FIG. 5 is a side sectional plan view showing the state of the belt unit after mounting.
Figure 6A:
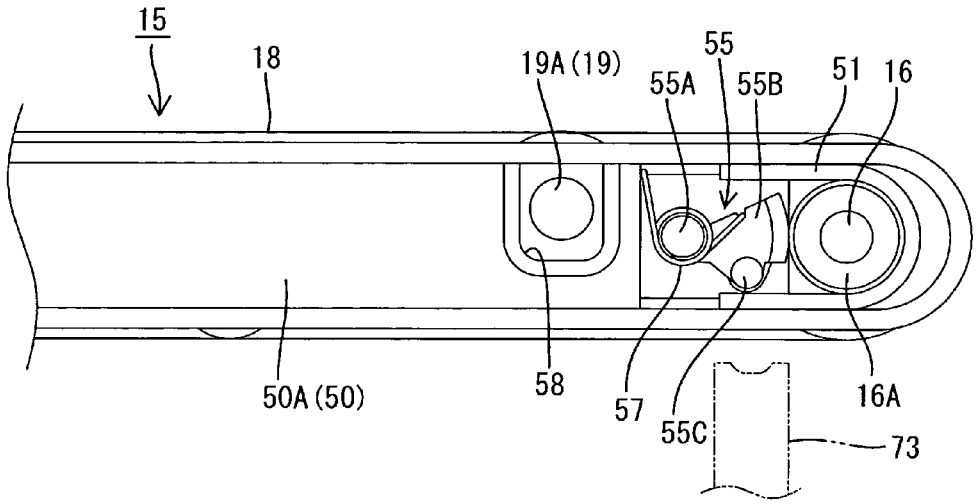
FIG. 6A is a partial enlarged side view showing the state of the belt unit prior to mounting.
Figure 6B:
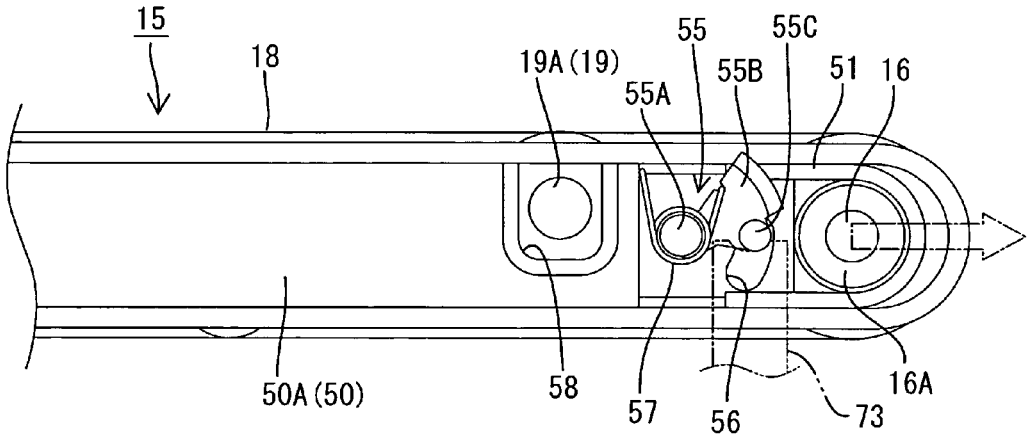
FIG. 6B is a partial enlarged side view showing the state of the belt unit after mounting.

FIGS. 3A and 3B are plan cross-sections showing enlarged views of a front end portion of the belt unit 15. FIG. 4 is a side sectional view showing the state of the belt unit 15 prior to mounting in the main body casing 2, and FIG. 5 is a side sectional view showing the state of the belt unit 15 after mounting in the main body casing 2. FIGS. 6A and 6B are side sectional views showing the movement of a fixing member 55 prior to and after mounting the belt unit 15 in the main body casing 2.

As shown in FIG. 4, the belt unit 15 comprises a belt frame 50 (corresponding to an example of the frame) made of synthetic resin that is formed as a unit in a rectangular tabular shape. The belt frame 50 includes a pair of side walls 50A respectively disposed on the left and right sides of the belt frame 50. Bearing devices 17A are mounted at each end of the shaft of the aforementioned driving roller 17 and are supported at the rear of each side wall 50A. The bearing devices 17A support the driving roller 17 in a rotatable condition.

A slide member 51 is provided at the front end portion of each side wall 50A. The slide member 51 can slide backward and forward. Bearing devices 16A are mounted at each end of the shaft of the tension roller 16 and are supported by the slide member 51. As a result, the tension roller 16 is supported in a rotatable condition and can change position within a predetermined range in the forward and backward directions.

As shown in FIG. 3A, cylindrical guide collars 52 are provided at each end of the tension roller 16 and the driving roller 17. The outer surfaces of the cylindrical guide collars 52 are indented in a step-like shape. Guide ribs 53 are provided in a protruding manner along the circumference of the conveyor belt 18, at both side ends on the inner surface thereof.

In a state in which the tension roller 16 is in a position approaching the outside (i.e., positioned away from the driving roller 17), the conveyor belt 18 is tightly suspended between the two rollers 16 and 17. In this state, each guide rib 53 engages with the outer surface of the guide collars 52 of the tension roller 16 and the driving roller 17 so as to prevent the skewing (i.e., horizontal or axial displacement) of the conveyor belt 18.

Further, as shown in FIG. 3B, when the tension roller 16 is at a position approaching the inside (i.e., positioned closer to the driving roller 17) and slackness has been created in the conveyor belt 18, the guide ribs 53 may float above the guide collars 52 of the rollers 16 and 17 and become disengaged therefrom. At this point, the conveyor belt 18 enters a state in which it is liable to be displaced horizontally (i.e., along an axial direction of the rollers 16 and 17).

As shown in FIG. 6A, a fixing member 55 (corresponding to an example of a fixing device) is provided at a front end portion of the side walls 50A in the belt frame 50. The fixing member fixes the position of the tension roller 16. The fixing member 55 is made of synthetic resin and integrally comprises a mounting shaft 55A that extends in a horizontal direction (i.e., substantially parallel to the axial direction of the roller 16), a fan part 55B that extends towards the front from the mounting shaft 55A with a substantially fan shape, and a guide shaft 55C that extends in a horizontal direction from the lower end of the fan part 55B.

The fixing member 55 is rotatably supported around the mounting shaft 55A. The guide shaft 55C passes through a groove 56, which is provided in each side wall 50A. The fixing member 55 can change position within a range from a fixation position, in which the guide shaft 55C is positioned at the lower end of the groove 56 (see FIG. 6A), to a release position, in which the guide shaft 55C is positioned at the upper end of the groove 56 (see FIG. 6B).

When the fixing member 55 is in the fixation position, the leading end of the fan part 55B engages with a rear side of the slide member 51 in order to fix the tension roller 16 in a location toward the front end. In this state, the conveyor belt 18 is suspended between the rollers 16 and 17 without significant slackness (i.e., secured to the belt unit 15).

When the fixing member 55 is in the release position, the fan part 55B recedes upward from the rear of the slide member 51. The tension roller 16 then enters a state in which it can change positions in the forward and backward directions. A spring 57 is provided around the mounting shaft 55A. The fixing member 55 is constantly urged towards the fixation position by this spring 57.

A roller shaft passage hole 58 is provided in each side wall 50A of the belt frame 50. The roller shaft 19A of a transfer roller 19 extends through the roller shaft passage hole 58. The roller shaft passage hole 58 is formed in a substantially rectangular shape. The dimensions of the roller shaft passage hole 58 in the vertical and horizontal directions are configured to be greater than the outer diameter of the roller shaft 19A. In a state where the belt unit 15 is detached from the main body casing 2, the roller shaft 19A is capable of changing positions in a diametrical direction (vertical and forward and backward directions) within the limits of the roller shaft passage hole 58.

(Structure Inside the Main Body Casing)

A main body frame (not shown) made of metal is provided inside the main body casing 2. As shown in FIG. 4, unit support parts 59 and 60 are made of synthetic resin and are used for supporting each pair of ends of the driving roller 17 and the tension roller 16. The unit support parts 59 and 60 are arranged in pairs at the front and rear of the main body frame on the left and right sides of the belt unit 15. The unit support part 60 at the rear side is formed to be substantially in the shape of a letter C, with an upward opening when viewed from a cross-sectional perspective. In the opening thereof, a latch fitting 61, which is formed in a V-shape when viewed in cross-section and is elastically deformable, is provided in a condition in which the latch fitting 61 protrudes inward (i.e., to the right as viewed in FIGS. 4 and 5).

As shown in FIG. 5, the bearing device 17A, mounted at each end of the driving roller 17, is inserted into the unit support part 60. The driving roller 17 is retained in a positioned state through the latching of each bearing device 17A by a corresponding latch fitting 61. At the front side the unit support part 59 is formed such that the upper surface thereof establishes a plane of a fixed height along the forward and backward direction. The tension roller 16 is supported in a state in which it is positioned in the height direction by placing both bearing devices 16A, which are mounted at each end of the tension roller 16, on a corresponding unit support part 59.

A pair of levers 70 is provided inside of the main body casing 2. The levers 70 can rotate around a rotating shaft 71. A pair of coiled springs 72, which urge the respective levers 70 in a clockwise direction (as viewed in FIGS. 4 and 5) (the levers 70 and the coiled springs 72 correspond to examples of a tension imparting device) are also provided inside of the main body casing 2.

When a bearing device 16A of the tension roller 16 is placed on the front unit support part 59, the bearing device 16A presses the top end of a lever 70 towards the rear. As a result, the corresponding coiled spring 72 is placed in an extended state. The bearing device 16A is urged towards the front by an elastic restoring force thereof, thereby imparting a tensile force to the conveyor belt 18.

Additionally, as shown in FIG. 6A, a releasing protrusion 73 (corresponding to an example of a fixation releasing device), is provided inside of the main body casing 2. The releasing protrusion 73 displaces the guide shaft 55C of the fixing member 55 to an upper side (i.e., the release position side) when mounting the belt unit 15.

In the main body frame within the main body casing 2, bearing members 63 are arranged in left and right side pairs corresponding to each transfer roller 19. The bearing members 63 are used for supporting the roller shafts 19A of the transfer rollers 19. Each bearing member 63 comprises a bearing groove 64 having a grooved shape that opens upward.

By inserting an end of the roller shaft 19A into the bearing groove 64 from an upward direction, the roller shaft 19A can be supported in a freely rotatable condition. At the edges of the opening of the bearing groove 64, guide surfaces 65 are formed to aid in guiding the roller shaft 19A into the bearing groove 64.

Each bearing member 63 is arranged so that it can change position in a vertical direction. In addition, each bearing member 63 is retained in a positioned state with respect to the main body frame in the cross and longitudinal directions. A spring 66 is provided on the underside of each bearing member 63 and urges the corresponding bearing member 63 in an upward direction.

(Operations When Attaching and Detaching the Belt Unit)

When exchanging the conveyor belt 18 or the like, as shown in FIG. 2, the belt unit 15 is taken out from the main body casing 2 in a state in which the top cover 3 is opened and the process cartridges 26 are removed. As shown in FIG. 6A, when the belt unit 15 is removed from the main body casing 2, the fixing member 55 shifts to a fixation position due to the urging of the spring 57, and latches to the rear side of the slide member 51. As a result, the tension roller 16 is fixed in a position in which it projects to the front. Therefore, the conveyor belt 18 is stretched between the two rollers 16 and 17 in a state almost without any slackness.

As shown in FIG. 4, to mount the belt unit 15 from a detached state into the main body casing 2, the belt unit 15 is lowered in a substantially horizontal position. The bearing devices 17A at both ends of the driving roller 17 are pushed into the interiors of the unit support parts 60. In addition, the bearing devices 16A at both ends of the tension roller 16 are placed on the unit support parts 59. As a result, as shown in FIG. 5, the belt unit 15 is held in a substantially horizontal position by the front and rear unit support parts 59 and 60.

During this process, the roller shaft 19A of each transfer roller 19 is guided by the respective guide surfaces 65 so as to insert the two ends of the roller shaft 19A into the corresponding bearing grooves 64 of the bearing members 63. Thus, each transfer roller 19 is positioned with respect to the front and rear directions.

The conveyor belt 18 is stretched by a predetermined operating tensile force since the bearing devices 16A push the top ends of the levers 70 rearward and are then urged forward by the elastic restoring force of the coiled springs 72. Thereafter, the transfer rollers 19 are also positioned with respect to the vertical direction since the transfer rollers 19 are pushed downward (against the urging force of the springs 66) by the photosensitive drums 31 when the process cartridges 26 are mounted above the belt unit 15.

(Advantages of This Aspect of the Image Forming Apparatus)

According to the present illustrative aspect described above, when the belt unit 15 is detached from the main body casing 2, displacement or inadvertent detachment of the conveyor belt 18 may be prevented, since the conveyor belt 18 is stretched by the outward projection of the tension roller 16. In addition, the conveyor belt 18 is retained in a stretched state by using the fixing member 55 to fix the tension roller 16 in a position in which it projects outward.

The fixation of the tension roller 16 due to the fixing member 55 is released by the releasing protrusion 73 when the belt unit 15 is mounted in the main body casing 2. Therefore, a suitable operating tensile force can be applied to the conveyor belt 18 by the coiled springs 72 that are provided on the main body casing 2 side.

Furthermore, since the releasing protrusion 73 releases the fixation of the tension roller 16 (due to the fixing members 55) occurring with an operation to mount the belt unit 15 in the main body casing 2, a separate operation to release the fixation of the tension roller 16 is not required when mounting the belt unit 15, thereby enhancing the workability of the system. Consequently, the structure of the belt unit 15 is simplified since an existing component such as the tension roller 16 comprises the securing member that projects outward to stretch the conveyor belt 18 when the belt unit 15 is detached from the main body casing 2.

However, if the conveyor belt 18 slackens and shifts horizontally (i.e., in a axial direction of a roller) when guide ribs 53 for skew prevention are provided on the inner surface of the conveyor belt 18, there is a risk of the guide ribs 53 overriding the guide collars 52 and dropping or falling off. If the belt unit 15 is mounted in this state and an operating tensile force is imparted to the conveyor belt 18 by the coiled springs 72, a difference in the surface level of the conveyor belt 18 is produced at the boundary between the region in which the conveyor belt 18 directly contacts a roller surface and the region in which the conveyor belt 18 contacts a roller surface via one of the guide ribs 53. This results in the possibility of a stress concentration being generated that will damage the conveyor belt 18.

Conversely, according to the present configuration it is possible to prevent or inhibit the aforementioned damage to the conveyor belt 18. The state in which the guide ribs 53 are engaged with the guide collars 52 is retained, since the conveyor belt 18 is stretched by the outward projection of the tension roller 16 when the belt unit 15 is detached from the main body casing 2.

<Additional Illustrative Aspect>

Another illustrative aspect of the image forming apparatus will be described next with reference to FIGS. 7 and 8.

Figure 7:
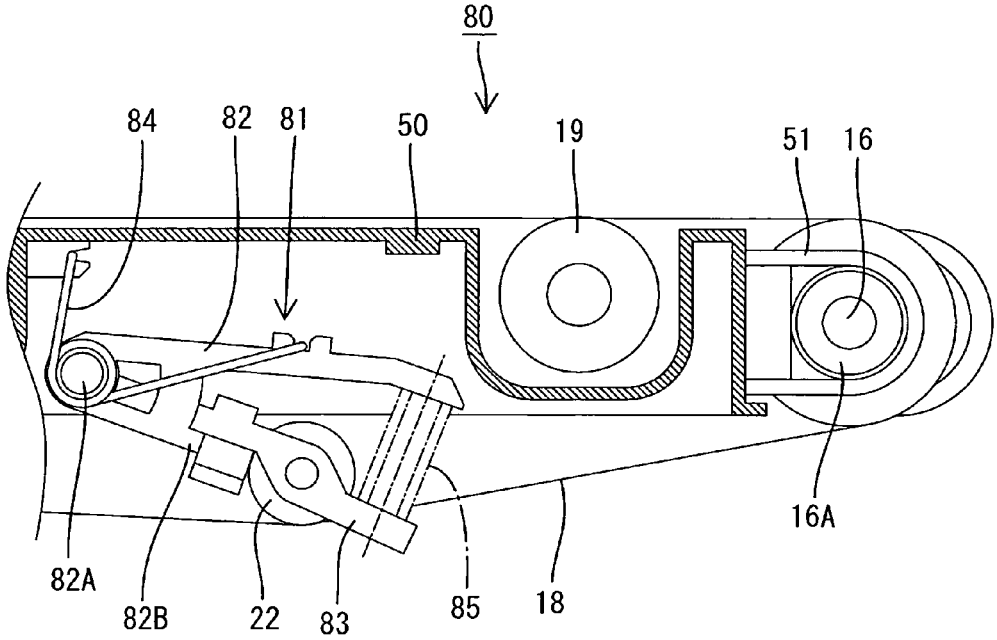
FIG. 7 is a partial enlarged side sectional view showing the state of a belt unit prior to mounting, according to another aspect.

FIG. 7 is an enlarged partial side sectional view showing a state in which a belt unit 80, according to this example structure, is detached from the main body casing 2. FIG. 8 is an enlarged partial side sectional view showing a state in which the belt unit 80 is mounted in the main body casing 2. In the following description, structural differences are mainly described with respect to the previous aspect. Components that have the same functions as those of the previous aspect are denoted by the same symbols. A duplicate description of these components is omitted.

Instead of the fixing member 55 and the spring 57 of the previous aspect, the belt unit 80 of the current aspect comprises an urging device 81 for urging the backup roller 22 (corresponding to an example of a securing member) in an outward direction. Two urging devices 81 are disposed as a pair in positions on the left and right ends of the backup roller 22. Each of the urging devices 81 respectively comprises a first supporting member 82, a second supporting member 83, a spring 84, and a spring 85.

The first supporting member 82 is provided in a condition in which it can rotate around a mounting shaft 82A, to a point below the belt frame 50. The first supporting member 82 is urged in a downward direction (i.e., a clockwise direction as viewed in FIGS. 7 and 8) by the spring 84.

One end of the second supporting member 83 is provided in a condition in which it can rotate around the mounting shaft 82A of the first supporting member 82. The other end (i.e., a free end side) of the second supporting member 83 supports the backup roller 22 in a freely rotatable condition. The second supporting member 83 is urged in a downward direction (i.e., clockwise direction as viewed in FIGS. 7 and 8) by a spring 85 that is provided between the first supporting member 82 and the second supporting member 83. In a state in which an external force is not applied to the second supporting member 83, the second supporting member 83 contacts against a stopper part 82B of the first supporting member 82.

In a state in which the belt unit 80 is detached from the main body casing 2, as shown in FIG. 7, the backup roller 22 is held in a position in which it projects downward further than the underside of the belt frame 50 due to the urging device 81. In addition, the backup roller 22 is pressed against the inner surface of the conveyor belt 18 due to the urging of the spring 84. The conveyor belt 18 thus placed into a state in which it is stretched without any significant amount of slackness.

At this time, the slide members 51 that support the bearing devices 16A of the tension roller 16 are pressed to the rear most end positions of their range of movement by the conveyor belt 18. A tensile force imparted to the conveyor belt 18 by the urging device 81 is made to be less than the operating tensile force imparted by the coiled springs 72 when the belt unit 80 is mounted in the main body casing 2. The tensile force of the urging device 81 is at least of a magnitude at which the conveyor belt 18 does not excessively slacken. In other words, the magnitude of the urging device 81 is such that the guide ribs 53 do not lift up away from the guide collars 52.

When mounting the belt unit 80 in the main body casing 2, the cleaning roller 21 (provided inside of the main body casing 2) contacts against the backup roller 22 via the conveyor belt 18. The contact of the cleaning roller 21 during the mounting process pushes up the backup roller 22. Furthermore, and similar to the mounting operation of the belt unit 80, an urge releasing protrusion 86 (corresponding to an example of an urge releasing device) provided within the main body casing 2 contacts against the lower end of the first supporting member 82 and pushes up the first supporting member 82.

Figure 8:
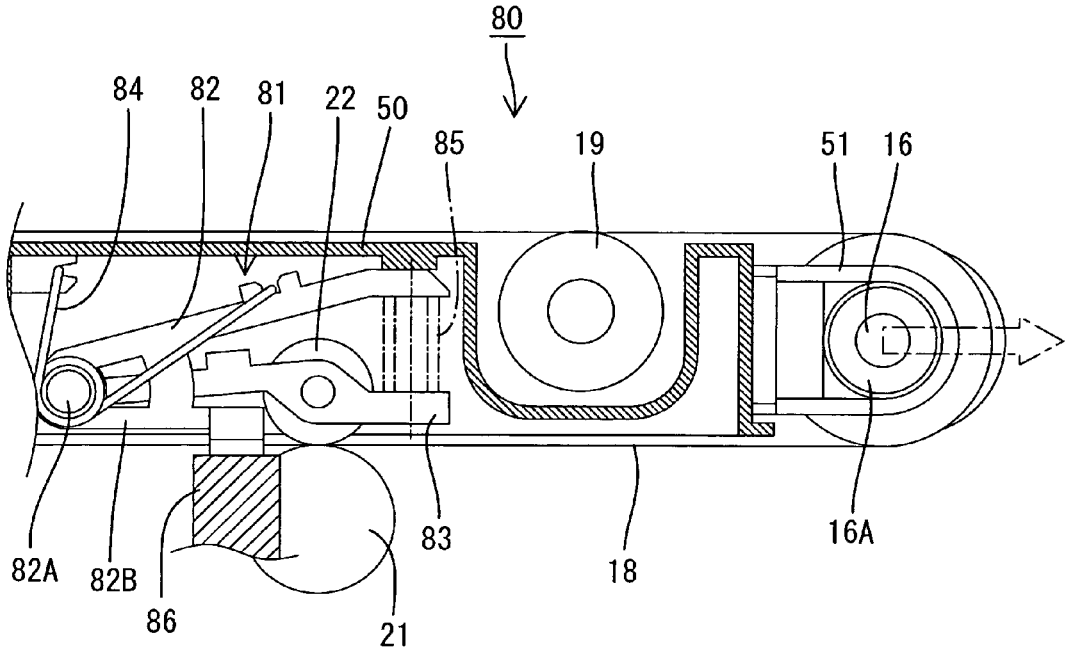
FIG. 8 is a partial enlarged side sectional view showing the state of the belt unit of FIG. 7 after mounting.

As shown in FIG. 8, when the belt unit 80 is mounted in the regular position, the backup roller 22 enters into a state in which it has nearly withdrawn to an upper side, with respect to the bottom of the belt frame 50. The backup roller 22 presses against the cleaning roller 21 as a result of urging by the spring 85. Additionally, the urging of the urging device 81 is released with respect to the conveyor belt 18. Since the bearing devices 16A of the tension roller 16 receive the elastic restoring force of the coiled springs 72, as previously described, and are urged toward the front side, a predetermined operating tensile force is imparted to the conveyor belt 18.

According to the current illustrative aspect, since the backup roller 22 is urged outward by the urging device 81, a tensile force is imparted to the conveyor belt 18 so that the conveyor belt 18 is held in a stretched state when the belt unit 80 is removed.

Since the tensile force imparted to the conveyor belt 18 by the urging device 81 is weaker than the operating tensile force imparted by the coiled springs 72 provided on the main body casing 2 side, the structure of the belt unit 80 can be simplified in comparison to a case in which an urging device is provided that imparts a tensile force to the belt unit 80 that is equal to the operating tensile force of the coiled spring 72. More specifically, for example, the rigidity of the belt frame 50 may be reduced, thereby enabling miniaturization of the belt unit 80.

An appropriate operating tensile force is imparted to the conveyor belt 18 by the coiled springs 72 since an urge generated by the urging device 81 is released by the urge releasing protrusion 86 when the belt unit 80 is mounted in the main body casing 2. Additionally, a separate operation to release the urging is not required since the urge releasing protrusion 86 releases the urging of the urging device 81 occurring with an operation to mount the belt unit 80. The workability of the image forming apparatus is thereby enhanced. The structure of the belt unit 80 is simplified since the securing member that projects outward to stretch the conveyor belt 18 when the belt unit 80 is detached from the main body casing 2 is composed by an existing component (i.e. the backup roller 22) and not a dedicated component.

In this respect, the urging towards the outer side of the belt that is generated by the spring 84 is released by the first supporting member 82 being pushed to the inner side of the belt unit 80 by the urge releasing protrusion 86. In addition, the backup roller 22 is urged towards the cleaning roller 21 by the spring 85 and the second supporting member 83. Although the urging force of the spring 84 is less than that of the coiled springs 72 based on a relationship between the space and the required load, this is simply because a large force is not required. It should be understood that there is no active reason requiring the force to be small.

<Additional Illustrative Aspect>

A further illustrative aspect of the image forming apparatus will now be described with reference to FIGS. 9 and 10.

Figure 9:
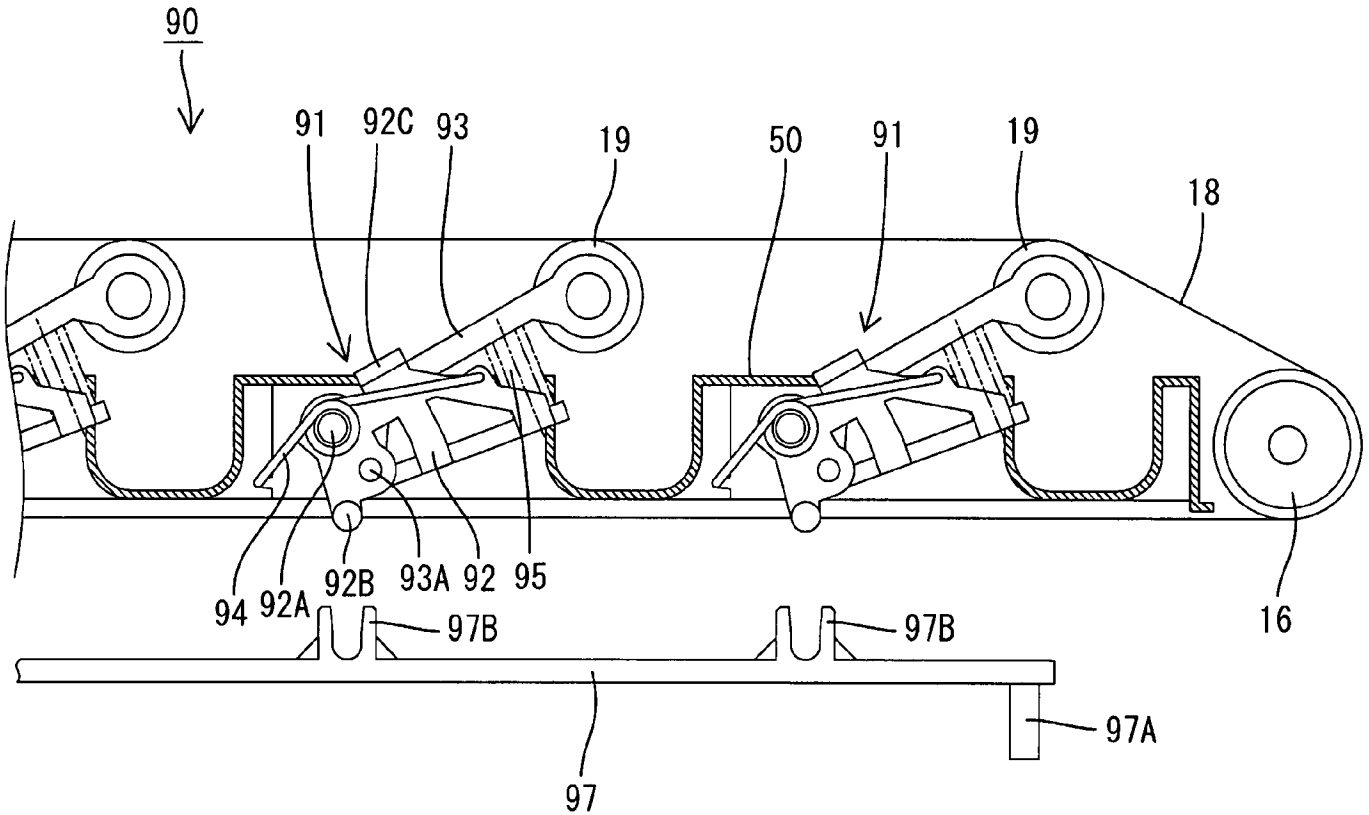
FIG. 9 is a partial enlarged side sectional view showing the state of a belt unit prior to mounting according to an additional aspect.
Figure 10:
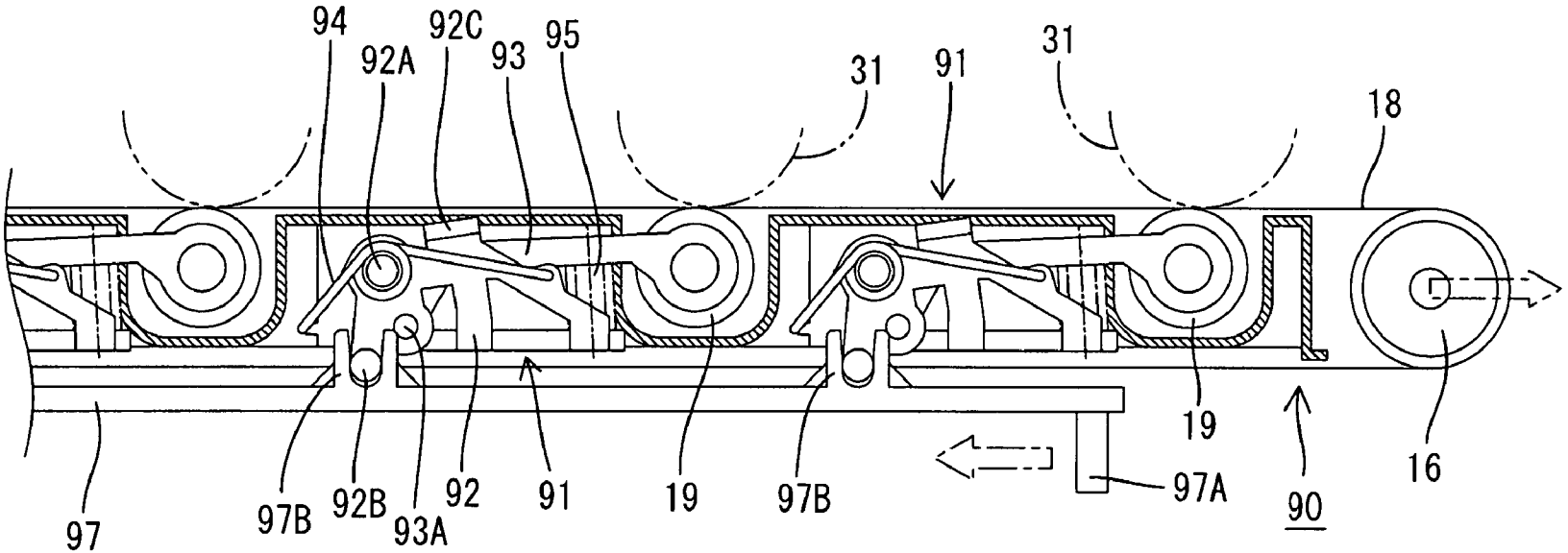
FIG. 10 is a partial enlarged side sectional view showing the state of the belt unit of FIG. 9 after mounting.

FIG. 9 is an enlarged partial side sectional view showing a state in which a belt unit 90, according to this aspect, is detached from the main body casing 2. FIG. 10 is an enlarged partial side sectional view showing a state in which the belt unit 90 is mounted in the main body casing 2. In the following description, structural differences are mainly described with respect to the previous aspects. Components that have the same functions as those of the previous aspects are denoted by the same reference symbols. A duplicate description of these components is omitted.

Instead of the fixing member 55 and the spring 57 of the previous aspect, the belt unit 90 of the current illustrative aspect comprises urging devices 91 for urging respective transfer rollers 19 (corresponding to examples of securing members) in an outward direction. Urging devices 91 are provided at positions on the left and right ends of each transfer roller 19. Each urging device 91 respectively comprises a first supporting member 92, a second supporting member 93, a spring 94, and a spring 95.

The first supporting member 92 is provided such that it can rotate around a mounting shaft 92A arranged in the belt frame 50. The first supporting member 92 is urged upward (i.e., a counter clockwise direction as viewed in FIGS. 9 and 10) by the spring 94. The first supporting member 92 includes a guidance pin 92B that extends laterally (i.e., horizontally) below the mounting shaft 92A.

A mounting shaft 93A is provided at one end of the second supporting member 93 and is arranged in a rotatable condition below the mounting shaft 92A of the first supporting member 92. The other end (i.e., free end side) of the second supporting member 93 supports a transfer roller 19 in a freely rotatable condition. The second supporting member 93 is urged upward (i.e., a counter clockwise or anti-clockwise direction as viewed in FIGS. 9 and 10) by the spring 95 provided between the first supporting member 92 and the second supporting member 93. The second supporting member 93 contacts against a stopper part 92C of the first supporting member 92 in a state in which an external force is not applied to the second supporting member 93.

A link lever 97 (corresponding to an example of an urge releasing device) is provided in the main body casing 2 that can slide backward and forward. An operation part 97A is provided in a protruding manner on the undersurface at the front end of the link lever 97. On the top surface of the link lever 97, pin engaging parts 97B are provided in a condition such that they can engage the guidance pins 92B of each first supporting member 92. The pin engaging parts 97B may contain a corresponding guidance pin 92B from the front and rear directions.

As shown in FIG. 9, in a state in which the belt unit 90 is detached from the main body casing 2, the transfer rollers 19 are held in a position in which they project upward further than the top surface of the belt frame 50 due to the urging devices 91. At this time, each of the transfer rollers 19 is pressed against the inner surface of the conveyor belt 18 due to the urging of a corresponding spring 94. As a result, the conveyor belt 18 is stretched without any excessive slackness. Also, the slide member 51 that supported the bearing device 16A of the tension roller 16 is pressed to a rear end position in its range of movement by the conveyor belt 18.

When the belt unit 90 is mounted in a normal position in the main body casing 2, each guidance pin 92B engages with a respective pin engaging part 97B of the link lever 97. Thereafter, when an operating force is applied to the operation part 97A so as to slide the link lever 97 backward, each guidance pin 92B moves to the rear side. As a result, the first supporting members 92 and the second supporting members 93 rotate downward around the mounting shafts 92A. The transfer rollers 19 descend to withdraw almost completely below the top surface of the belt frame 50 (e.g., the top ends of the transfer rollers 19 may project slightly above the top surface of the belt frame 50).

Thereby, the urging due to the urging devices 91 is released with respect to the conveyor belt 18. Since the tension roller 16 receives the elastic restoring force of the coiled springs 72 and is urged toward the front side, a predetermined operating tensile force is imparted to the conveyor belt 18. Subsequently, when the process cartridges 26 are mounted above the belt unit 90, each of the transfer rollers 19 is pushed down to a predetermined degree by a respective photosensitive drum 31. Additionally, the transfer rollers 19 are pressed into contact with the photosensitive drums 31 due to the urging of the springs 95.

As previously described, according to the present aspect, the structure of the belt unit 90 is simplified since the securing member is composed by existing components such as the transfer rollers 19, and not a dedicated component.

<Additional Illustrative Aspect>

An additional illustrative aspect of the image forming apparatus will now be described with reference to FIGS. 11 and 12.

Figure 11:
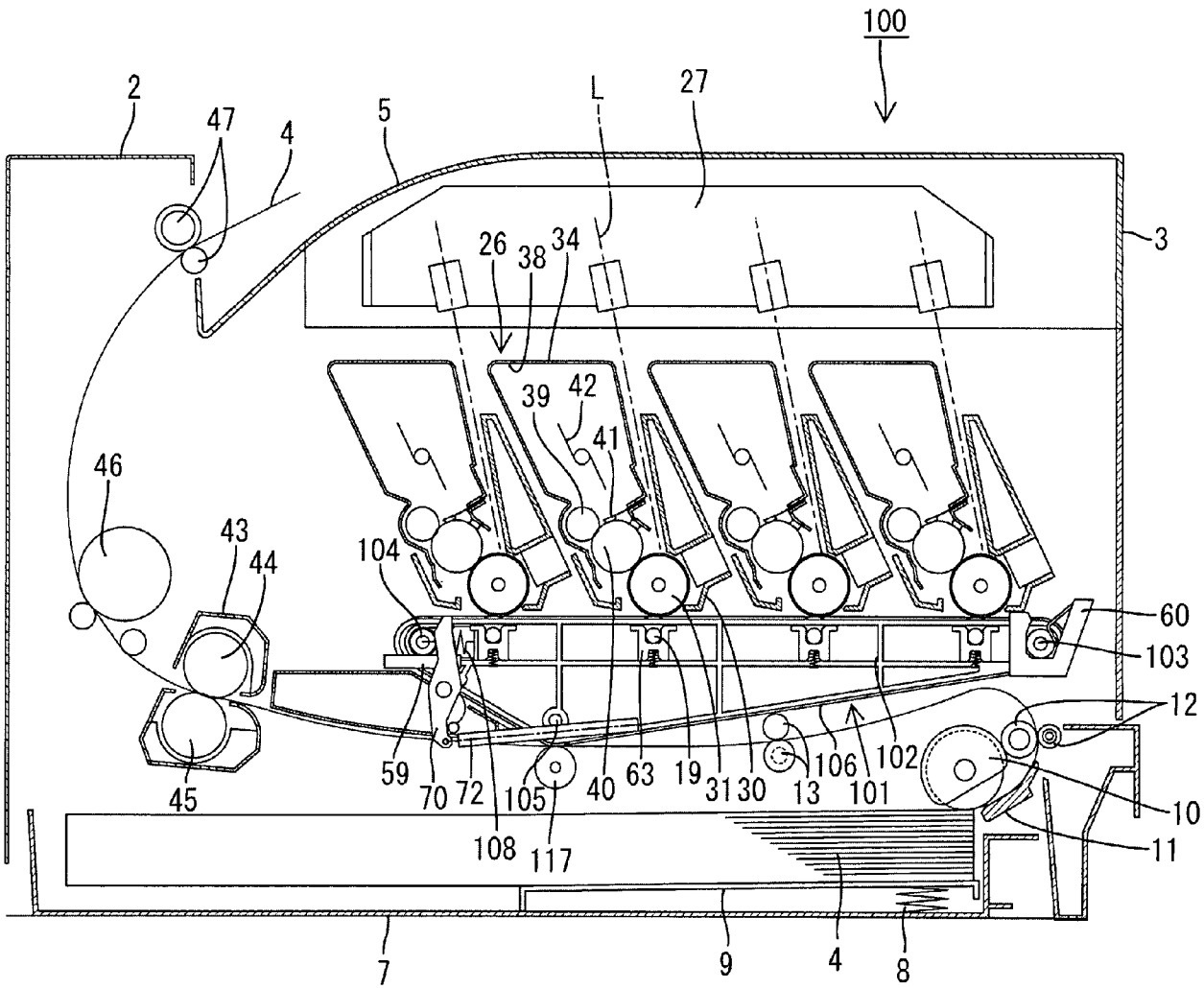
FIG. 11 is a side sectional view showing a schematic configuration of a laser printer according to a further aspect.
Figure 12:
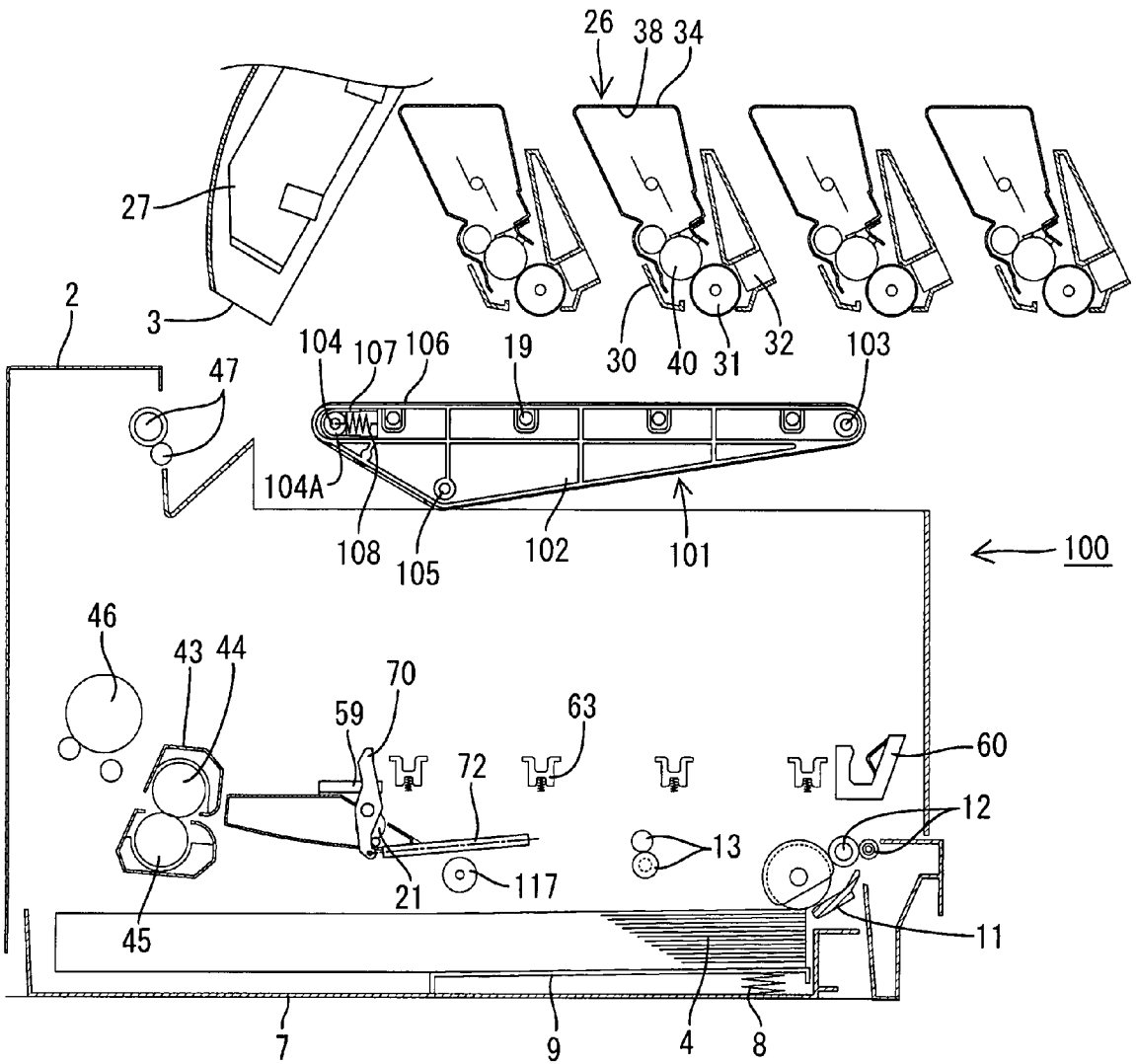
FIG. 12 is a side sectional view of the laser printer in a state in which the belt unit of FIG. 11 was detached therefrom.

FIG. 11 is a side sectional view showing the schematic configuration of a laser printer 100 as an image forming apparatus of the present aspect. FIG. 12 is a side sectional view of the laser printer 100 in a state in which process cartridges 26 and a belt unit 101 are detached there from. In the following description, the right side in FIGS. 11 and 12 is taken to be the front side.

The laser printer 100 of the present aspect is a tandem-type color laser printer that employs an intermediate transfer method using an intermediate transfer belt 106. In the following description, components having substantially the same functions as those of the previous aspects are denoted by the same reference symbols. A duplicate description of these components is omitted.

The laser printer 100 comprises a belt unit 101 that is detachable from the main body casing 2. The belt unit 101 comprises a belt frame 102 that is composed by an insulative synthetic resin material. The belt frame 102 forms a substantially triangular shape when viewed from the side.

A driving roller 103, a tension roller 104 (corresponding to an example of a securing member), and a driven roller 105, are respectively provided at the front end, the rear end, and the lower end, of the belt frame 102. The intermediate transfer belt 106 is stretched by these rollers 103, 104, and 105. Underneath the belt unit 101, a secondary transfer roller 117 is arranged, facing the driven roller 105 at the lower end of the belt frame 102, such that the intermediate transfer belt 106 is sandwiched between the secondary transfer roller 117 and the driven roller 105. The laser printer 100 is configured so that a secondary transfer bias is applied between the secondary transfer roller 107 and the driven roller 105.

The laser printer 100 is configured such that the four colors of toner images, which are respectively formed by four photosensitive drums 31, are temporarily transferred onto the intermediate transfer belt 106. Thereafter, when a sheet 4 passes through the position where the secondary transfer roller 117 is pressed into contact with the intermediate transfer belt 106, the toner images that were transferred onto the intermediate transfer belt 106 are transferred onto the sheet 4.

At the rear end of the belt frame 102 is provided a slide member 107 that can slide forward and backward. Bearing devices 104A, which are mounted at both ends of a shaft of the tension roller 104, are supported by the slide member 107. The slide member 107 is urged in an outward (backward) direction by a spring 108.

In a state in which the belt unit 101 is mounted in the main body casing 2, as shown in FIG. 11, the conveyor belt 18 is stretched by a predetermined operating tensile force since the tension roller 104 receives an urging force from the coiled springs 72 and the springs 108 such that it is urged in an outward direction.

Further, in a state in which the belt unit 101 is detached from the main body casing 2, as shown in FIG. 11, the conveyor belt 18 is held in a state in which it is stretched without a significant amount of slackness since the tension roller 104 projects outward due to the outward urging of the springs 108. At this time, the tensile force imparted to the conveyor belt 18 by the springs 108 is designed to be less than the operating tensile force imparted by the coiled springs 72 when mounting the belt unit 101 in the main body casing 2. Therefore, the rigidity of the belt frame 102 can be reduced in comparison to a case in which an urging device is provided that imparts a tensile force to the belt unit 101 that is equal to the operating tensile force of the coiled springs 72. Consequently, miniaturization of the belt unit 101 is enabled.

<Other Aspects>

The present invention is not limited to the illustrative aspects described by the foregoing descriptions and drawings. For example, the following exemplary aspects are also included within the technical scope of the present invention. Various changes and modifications, other than those described below, may be made therein without departing from the spirit or the subject matter of the invention.

(1) In each of the previously described aspects the securing member was composed by an existing component such as a tension roller. However, the securing member may also be composed by a component that is specifically provided for that purpose.

(2) In each of the previously described aspects the belt of the belt unit was configured as a conveyor belt or an intermediate transfer belt. However, the present invention may also be applied to an image forming apparatus in which a belt is configured as a photosensitive belt.

What is claimed is:

1. An image forming apparatus comprising:

a belt unit includes a belt, a plurality of rollers supporting the belt, and a frame rotatably supporting the rollers; and an apparatus main body in which the belt unit is detachably mounted;

wherein the belt unit comprises:

a securing member disposed at an inner surface side of the belt and configured to impart a tensile force to the belt when the belt unit is detached from the apparatus main body; and an urging device that imparts the tensile force to the belt by generating an urge that applies an outward force to the securing member in a state in which the belt unit is detached from the apparatus main body;

wherein the apparatus main body comprises:

a tension imparting device that imparts an operating tensile force to the belt of the belt unit in a mounted state; and wherein the tensile force imparted to the belt by the urging device is less than the operating tensile force that is imparted to the belt by the tension imparting device.

2. The image forming apparatus according to claim 1, wherein the apparatus main body comprises:

an urge releasing device that releases the urge generated by the urging device in a state in which the belt unit is mounted in the apparatus main body.

3. The image forming apparatus according to claim 2, wherein the urge releasing device releases the urge generated by the urging device occurring with an operation to mount the belt unit in the apparatus main body.

4. The image forming apparatus according to claim 1, wherein the belt unit comprises:

a fixing device configured to fix the securing member in an outwardly projecting position in a state in which the belt unit is detached from the apparatus main body.

5. The image forming apparatus according to claim 4, wherein the apparatus main body comprises:

a fixation releasing device that releases the fixation of the fixing device in a state in which the belt unit is mounted in the apparatus main body.

6. The image forming apparatus according to claim 5, wherein the fixation releasing device releases the fixation by the fixing device occurring with an operation to mount the belt unit in the apparatus main body.

7. The image forming apparatus according to claim 1, wherein the securing member comprises:

a tension roller that imparts the operating tensile force to the belt via the tension imparting device in a state in which the belt unit is mounted in the apparatus main body.

8. The image forming apparatus according to claim 1, wherein the securing member comprises:

a transfer roller that is disposed opposite an image bearing device provided in the apparatus main body such that the belt is positioned between the transfer roller and the image bearing device; and wherein the transfer roller transfers a developer image that is carried on the image bearing device via application of a transfer bias between the image bearing device and the transfer roller.

9. The image forming apparatus according to claim 1, wherein the apparatus main body comprises:

a cleaning roller that contacts against an outer surface of the belt; and wherein the securing member comprises a cleaner backup roller that is disposed opposite to the cleaning roller to position the belt between the cleaner backup roller and the cleaning roller.

10. The image forming apparatus according to claim 1, wherein the belt comprises:

a protruding guide rib on an inner surface that engages with the rollers to inhibit skewing of the belt.

11. An image forming apparatus including a belt unit detachably mounted to an apparatus main body and comprising a belt, a plurality of rollers supporting the belt in a stretched state, and a frame rotatably supporting the rollers, and also including a tension imparting device that imparts an operating tensile force to the belt of the belt unit in a mounted state, wherein the belt unit comprises:

a plurality of securing members located along an inner surface side of the belt that impart a tensile force to the belt when the belt unit is detached from the apparatus main body, wherein each of the plurality of securing members comprises a transfer roller positioned opposite to a photosensitive drum of one of a corresponding plurality of development cartridges via the belt when the belt unit and the plurality of development cartridges are in a mounted condition.

12. The image forming apparatus of claim 11 wherein each of the plurality of securing members imparts the tensile force to the belt via a corresponding plurality of urging devices;

wherein the image forming apparatus comprises an operation part that engages said each of the plurality of urging devices when the belt unit is mounted to the image forming apparatus; and wherein the operation device is actuated to release the tensile force generated by the plurality of urging devices.

13. The image forming apparatus of claim 12, wherein each of the plurality of urging devices comprises a first resilient member and a second resilient member;

wherein each of the second resilient members generate a contact force;

wherein the first resilient members and the second resilient members generate the tensile force; and wherein the contact force presses the belt between each of the transfer rollers and a photosensitive drum of each of a corresponding plurality of development cartridges.

14. An image forming apparatus comprising a belt unit detachably mounted in an apparatus main body and including a belt, a plurality of rollers supporting the belt in a stretched state, and a frame rotatably supporting the rollers, wherein the belt unit comprises:

a securing member disposed at an inner surface side of the belt and configured to impart a tensile force to the belt when the belt unit is detached from the apparatus main body;

wherein the image forming apparatus includes a tension imparting device that imparts an operating tensile force to the belt of the belt unit when the belt unit is attached to the apparatus main body;

wherein the securing member is a backup roller that imparts the tensile force via a change of position in a tension inducing direction with respect to the belt due to an urging of an urging device; and the image forming apparatus comprising an urge releasing device that releases the tensile force when the belt unit is attached to the apparatus main body.

15. The image forming apparatus according to claim 14, wherein the belt comprises:

a protruding guide rib on an inner surface that engage with the rollers to guide the belt.

* * * * *